US005566411A

United States Patent [19]

Eiler

[11] Patent Number: 5,566,411

[45] Date of Patent: Oct. 22, 1996

[54] BEDDING ENSEMBLE

[76] Inventor: Robyn F. Eiler, 5402 Francisco Dr., Greensboro, N.C. 27410

[21] Appl. No.: 505,473

[22] Filed: Jul. 21, 1995

[51] Int. Cl.[6] ..... A47G 9/00; A47G 9/02; A47G 9/04

[52] U.S. Cl. ..... 5/494; 5/497; 5/484; 5/502; 5/493

[58] Field of Search ..... 5/493, 494, 496, 5/498, 497, 484, 482, 500, 502

[56] References Cited

U.S. PATENT DOCUMENTS

| | | | |
|---|---|---|---|
| 2,789,292 | 4/1957 | Budinquest | 5/496 |
| 3,083,378 | 4/1963 | Pursell | 5/498 |
| 3,530,487 | 9/1970 | Brer | 5/496 |
| 3,570,026 | 3/1971 | Allison | 5/496 |
| 4,304,018 | 12/1981 | McClam | 5/494 |
| 4,413,368 | 11/1983 | Schuetze | 5/494 |
| 4,546,508 | 10/1985 | Ison | 5/494 |
| 4,615,061 | 10/1986 | Scott | 5/497 |
| 4,899,408 | 2/1990 | Illingworth | 5/496 |
| 4,972,533 | 11/1990 | Brown | 5/413 |
| 5,003,655 | 4/1991 | Kafal | 5/496 |
| 5,042,099 | 8/1991 | Brenner et al. | 5/496 |
| 5,086,530 | 2/1992 | Blake | 5/496 |
| 5,092,010 | 3/1992 | Wong | 5/496 |
| 5,208,927 | 5/1993 | Lachmar | 5/497 |
| 5,321,862 | 6/1994 | Campbell | 5/482 |

*Primary Examiner*—Alexander Grosz

[57] ABSTRACT

A bedding ensemble includes a mattress fitting lower portion which is covered with skirt panels. A top cover is attached which may be quilted and includes a perimeter zipper. When in use the top cover can be released by unzipping around the periphery and unfolded. An inner cover is included and can be removed by unzipping also for washing and cleaning without the entire ensemble having to be removed from the mattress. A blanket layer is also provided in an alternate embodiment to ensure sufficient warmth during sleeping and an easily insertable, liquid-impermeable, rectangular mat beneath the inner layer protects the mattress against bed-wetting. The ensemble allows for quick and efficient bed "making" by children, handicapped or infirm persons.

7 Claims, 4 Drawing Sheets

BEDDING ENSEMBLE

FIELD OF THE INVENTION

The invention herein, pertains to bedding items and particularly to combination bed covering items which are affixed to a mattress for sleeping purposes.

BACKGROUND AND OBJECTIVES OF THE INVENTION

Various bedding items have been conceived in the past for use with mattresses and box springs to provide comfort, warmth and convenience for the user. However, certain of the prior art devices are difficult to remove from the bed and mattress for washing, while others have required the entire apparatus including the coverings to be removed and washed at one time also causing great inconvenience. Other old devices have not been form-fitted to a bed or mattress and are difficult to maintain in place, especially when used by children. Other bedding devices do not provide the area needed in the top covers for the desired comfort and covering ability of the user.

Thus, with the disadvantages and problems associated with the prior art bedding devices, the present invention was conceived and one of its objectives is to provide a bedding ensemble which can be placed over a mattress and be securely maintained by an elastic band along the bottom thereof.

It is yet another objective of the present invention to provide a bedding ensemble which includes a relatively thick top cover having an excess length when unfolded, yet which will fold into a tight compact bed covering when the bed is "made".

It is still another objective of the present invention to provide a bedding ensemble which includes a removable thin inner cover which acts as a conventional sheet and which is releasably affixed for convenience when washing.:

It is also an objective of the present invention to provide a bedding ensemble with decorative skirt panels to contribute an appealing appearance.

It is a further objective of the invention to provide a bedding ensemble which will allow children, handicapped persons or others to quickly and easily make their bed.

It is also another objective of the present invention to provide an alternative embodiment of the bedding ensemble which includes a blanket layer which is optionally attached if needed.

Various other objectives and advantages of the present invention will become apparent to those skilled in the art as a more detailed description is set forth below.

SUMMARY OF THE INVENTION

The invention herein allows the realization of the aforesaid objectives by providing an ensemble which can be placed over a bed mattress and is particularly suited for bunk-type beds, beds in retirement homes, bed facilities for handicapped persons and others with a need for beds that are "easy-to-make".

In use, the lower portion of the ensemble is placed over a conventional rectangular mattress whereby an elastic band strip holds the lower form fitting section thereon. The top of the form fitting section covers the mattress and includes a perimeter zipper track along three sides for engaging a mating zipper track of a top cover. A quilted top cover is attached, such as by sewing, along one side and a zipper track is affixed along the other three sides. The top cover has, in the preferred form, an excess width when unfolded to provide an abundance of material for covering a person laying thereunder. Skirt panels provide a decorative effect and conceal the lower portion of the ensemble although such skirt panels are optional and may not be desired in all instances. A thin inner cover, which forms a pocket and acts as a bed sheet, is also releasably attached to the top as with a zipper or other fastening means for convenience in use and in cleaning. An optional rubber or other liquid-impermeable pad can be placed under the inner cover for protection against bed-wetting. Thus, small children, handicapped persons and others can easily use the bedding ensemble and can "make" the bed simply by minimum folding and zipping the top covering and can easily remove the inner cover for washing.

DETAILED DESCRIPTION OF THE PREFERRED EMBODIMENT AND OPERATION OF THE INVENTION

Figure 4:
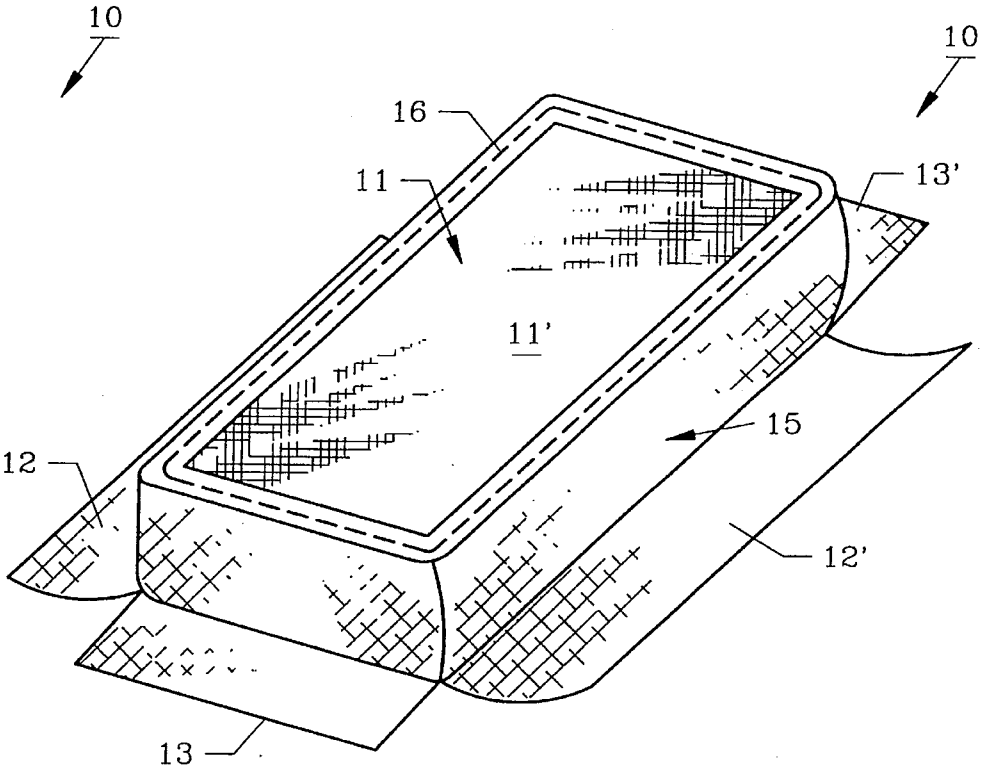
FIG. 4 illustrates an inverted view of the mattress and ensemble as seen in FIG. 1 to show the relative positions thereof.
Figure 1:
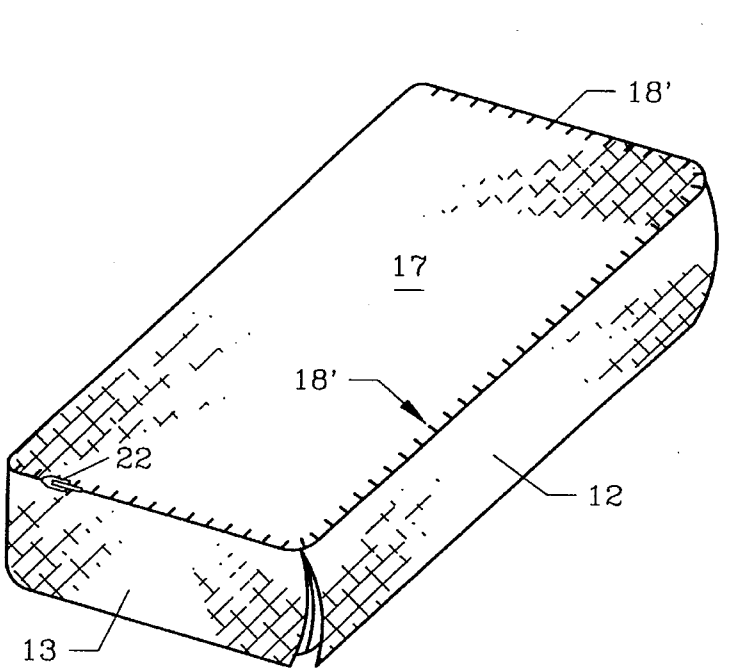
FIG. 1 shows the preferred form of the bedding ensemble in a closed or "made" position on a conventional mattress, removed from a bed.
Figure 2:
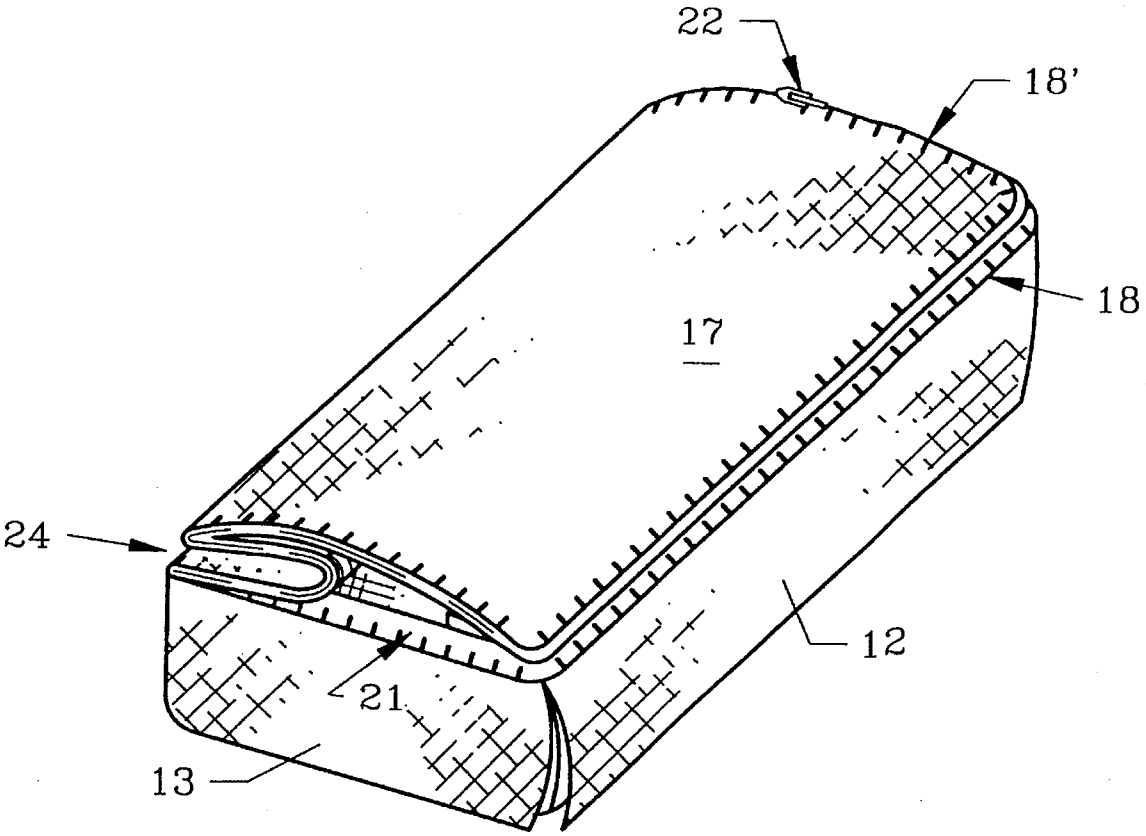
FIG. 2 depicts the ensemble of FIG. 1 with the surrounding zipper open.
Figure 3:
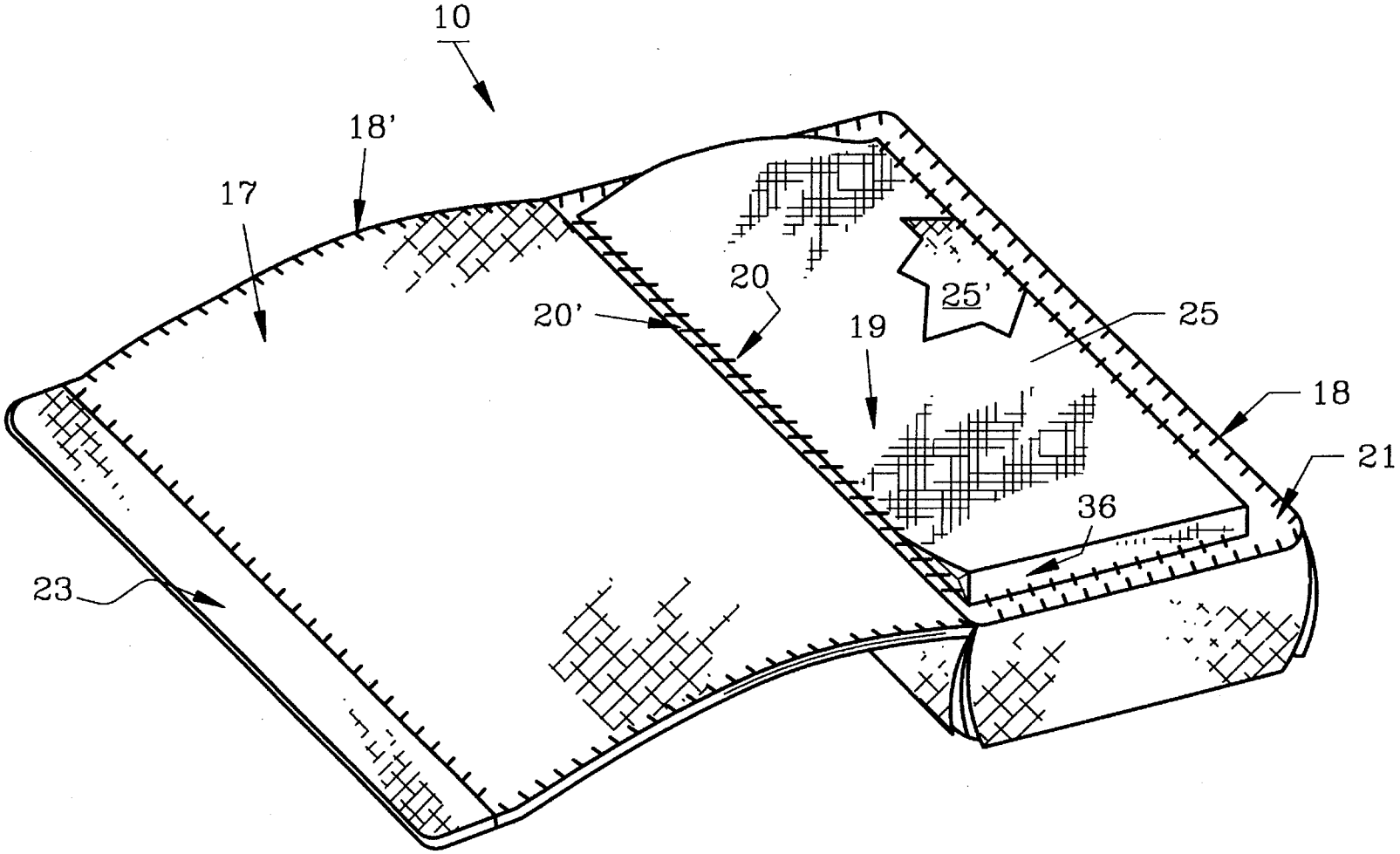
FIG. 3 demonstrates the ensemble with the top cover unfolded, exposing the inner cover.

Turning now to the drawings, FIGS. 1–4 demonstrate the preferred form of the invention whereby bedding ensemble 10 is shown in FIG. 1 positioned on mattress 11, shown inverted in FIG. 4 for clarity. Bedding ensemble 10 includes a top cover 17 which, as seen in FIG. 3, can be unzipped and unfolded for use as a cover during sleeping. Ensemble 10 also includes side skirt panels 12, 12' and end skirt panel 13, 13' as shown in FIGS. 1 and 4. Skirt panels 12, 12', 13, 13' while optional provide a decorative effect to the lower portion of ensemble 10 and hide form fitting portion 15 which engages mattress 11 and is held in place along the bottom of mattress 11 by elastic band 16, as seen in FIG. 4. Form-fitting portion 15 includes a top 21 (FIG. 3) having zipper track 18. Zipper track 18 cooperatively engages zipper track 18' whereby top cover 17 can be releasably closed against top 21 as seen in FIG. 1 to "make" the bed. Zipper tracks 18, 18' are engage by use of conventional zipper pull 22 shown in FIGS. 1 and 2 whereby top cover 17 can be released and then unfolded therefrom as shown in FIG. 3 when needed. Top cover 17 includes an extension 23 to provide additional width as may be needed to provide abundant cover and comfort during sleeping. Top cover 17 and top cover extension 23 are formed of a quilted or relatively thick padded material, whereas skirt panels 12, 12', 13, 13', form fitting portion 15 and top 21 are made from relatively thin, lined, or single-ply fabrics. FIG. 2 demonstrates the excess length of top cover 17 by fold 24 which allows extra length for sleeping comfort, as does extension 23. Top cover 17 is seen unzipped in FIG. 2 from top 21.

In FIG. 3, inner cover 19 is seen, which is, for example, a folded sheet material having a top layer 25 and a bottom layer 25' (shown beneath the cut-away) which is joined to top 21 by surrounding zipper track 20. As would be understood, inner cover 19 can be unzipped from ensemble top 21 which includes a mating zipper track 20' for removal as needed, preventing washing the whole of ensemble 10. End panel 36 of inner cover 19 provides extra room for the user's feet and allows inner cover 19 to create a "pocket" for sleeping therein.

Figure 5:
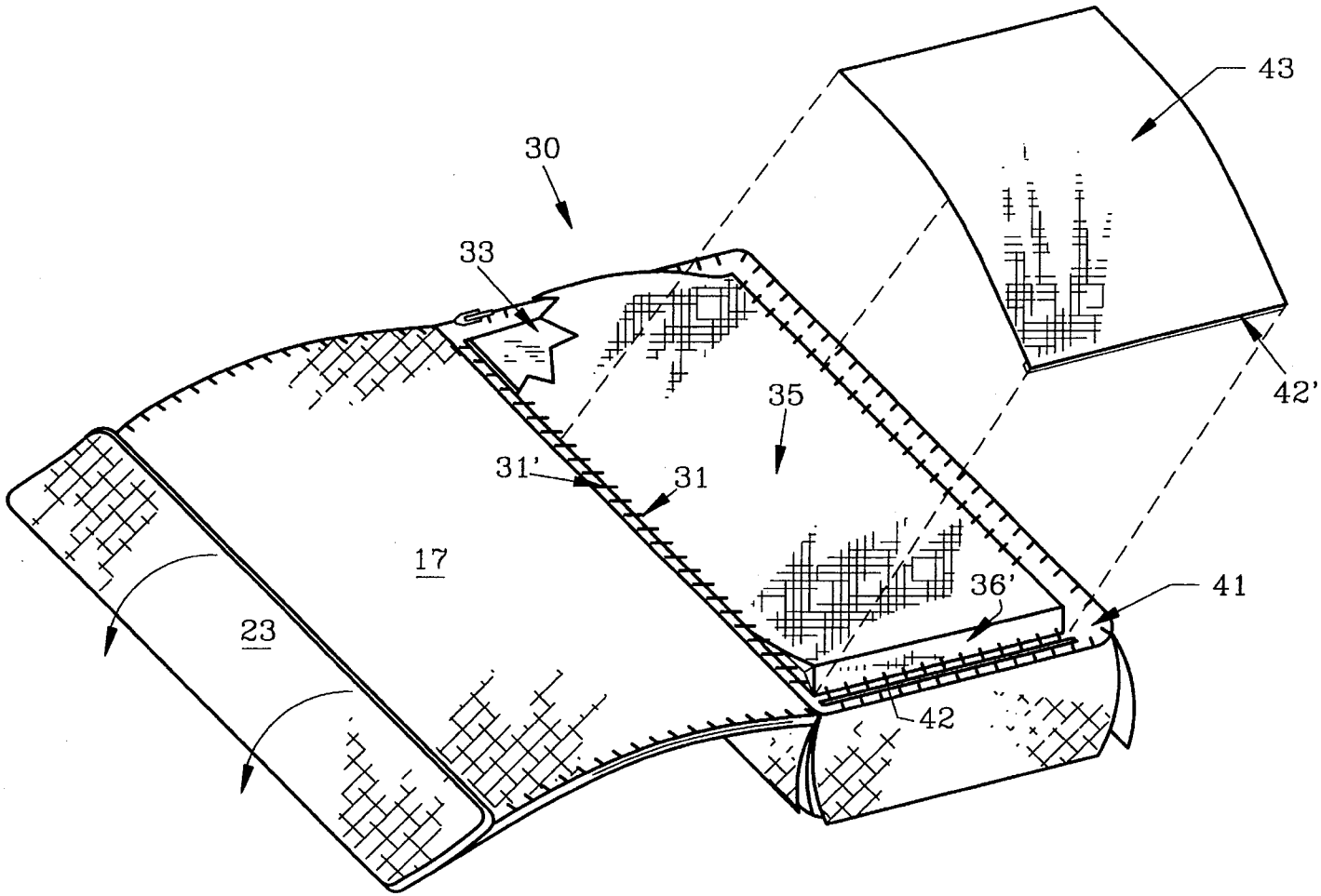
FIG. 5 pictures an alternate embodiment of the ensemble having a removable blanket layer and rubber mat.

An alternate embodiment of the invention is shown in FIG. 5 whereby bedding ensemble 30 is seen with inner cover 35 which is affixed to ensemble top 41 by surrounding zipper track 31 which engages zipper track 31'. Inner cover 35 includes a top and bottom layer (not seen) and is likewise formed from a single layer fabric but has a reinforced foot panel 36' and provides extra strength and room for the user therein. Rubber mat 33 consists of a thin rectangular shape and is seen positioned on top 41, beneath inner cover 35 to protect against bed wetting. Mat 33 could also be formed of plastics or other suitable materials. Hook and loop fastening strip 42 is affixed to top 41 such as by sewing and allows releasable attachment of blanket layer 43 which includes mating hook and loop fastening strip 42'. If needed, blanket layer 43 is used atop inner cover 35 to provide additional warmth for the user.

The illustrations and examples provided herein are for explanatory purposes only and are not intended to limit the scope of the appended claims. As would be understood, the exact dimensions and shapes of the ensemble can be changed and either left or right side zippers can be employed, depending on the particular beds used and their positioning in selected rooms or facilities.

I claim:

1. A bedding ensemble for covering a rectangular mattress, said bedding ensemble comprising:

(a) a mattress engaging portion, said mattress engaging portion fitted around said mattress, said mattress engaging portion comprising an elastic band, said elastic band positioned beneath said mattress to secure said mattress;

(b) a top, said top attached to said mattress engaging portion;

(c) a top cover, said top cover having rectangular shape, said top cover positioned on said top, said top cover comprising means to releasably fasten said top cover to said top along three sides, said top cover permanently affixed to said top along one side, said top cover having width substantially equal to said mattress width, said top cover comprising an extension, said extension attached to said top cover opposite said foldably affixed side, said top cover and said extension having a combined width greater than said mattress width, said extension for folding beneath said top cover so as to be positioned between said top cover and said top;

(d) a skirt panel, said skirt panel attached to said top for covering said mattress engaging portion;

(e) an inner cover, said inner cover removably affixed to said top, said inner cover comprising a top layer, a bottom layer, and a reinforced foot panel;

(f) a first zipper, said first zipper attached to said top, said first zipper for releasably joining said top cover and said extension to said top when said extension is folded beneath said top cover.

2. The bedding ensemble of claim 1 further comprising a rubber mat, said rubber mat positioned between said inner cover and said top.

3. The bedding ensemble of claim 1 further comprising a blanket, said blanket positioned upon said inner cover.

4. A bedding ensemble for covering a rectangular mattress, said bedding ensemble comprising:

(a) a mattress engaging portion, said mattress engaging portion fitted around said mattress, said mattress engaging portion comprising an elastic band, said elastic band positioned beneath said mattress to secure said mattress;

(b) a top, said top attached to said mattress engaging portion;

(c) a top cover, said top cover having rectangular shape, said top cover positioned on said top, said top cover comprising means to releasably fasten said top cover to said top along three sides, said top cover permanently affixed to said top along one side, said top cover having width substantially equal to said mattress width, said top cover comprising an extension, said extension attached to said top cover opposite said foldably affixed side, said top cover and said extension having a combined width greater than said mattress width, said extension for folding beneath said top cover so as to be positioned bet ween said top cover and said top;

(d) an inner cover said inner cover removably affixed to said top, said inner cover comprising a top layer, a bottom layer, and a reinforced foot panel;

(e) a first zipper, said first zipper attached to said top, said first zipper for releasably joining said top cover and said extension to said top when said extension is folded beneath said top cover; and (f) a second zipper, said second zipper attached to said top, said second zipper for releasably joining said inner cover to said top, whereby said inner cover can be selectively removed and reattached.

5. The bedding ensemble of claim 4 further comprising a rubber mat, said rubber mat positioned between said inner cover and said top.

6. The bedding ensemble of claim 4 further comprising a blanket, said blanket positioned upon said inner cover.

7. The bedding ensemble of claim 4 further comprising a plurality of skirt panels, each of said skirt panels attached to said top for covering said mattress engaging portion.

* * * * *